US011414797B2

(12) United States Patent
Wörnle et al.

(10) Patent No.: US 11,414,797 B2
(45) Date of Patent: Aug. 16, 2022

(54) DEVICE FOR LOOP-FORMING, SINKER MEANS AND METHOD FOR LOOP FORMING

(71) Applicants: Groz-Beckert KG, Albstadt (DE); Santoni S.P.A., Brescia (IT)

(72) Inventors: Martin Wörnle, Mössingen (DE); Marco Andreoli, Castegnato (IT); Stefano Rizzi, Brescia (IT)

(73) Assignees: Groz-Beckert KG, Albstadt (DE); Santoni S.P.A., Brescia (IT)

( * ) Notice: Subject to any disclaimer, the term of this patent is extended or adjusted under 35 U.S.C. 154(b) by 0 days.

(21) Appl. No.: 17/287,848

(22) PCT Filed: Oct. 9, 2019

(86) PCT No.: PCT/EP2019/077320
§ 371 (c)(1),
(2) Date: Apr. 22, 2021

(87) PCT Pub. No.: WO2020/083644
PCT Pub. Date: Apr. 30, 2020

(65) Prior Publication Data

US 2021/0310164 A1 Oct. 7, 2021

(30) Foreign Application Priority Data

Oct. 23, 2018 (EP) ..... 8202046

(51) Int. Cl.
*D04B 15/06* (2006.01)
*D04B 15/14* (2006.01)

(52) U.S. Cl.
CPC ..... *D04B 15/06* (2013.01); *D04B 15/14* (2013.01)

(58) Field of Classification Search
CPC ..... D04B 15/06; D04B 15/14; D04B 27/04; D04B 9/06
(Continued)

(56) References Cited

U.S. PATENT DOCUMENTS 1,738,851 A * 12/1929 Tauscher ..... D04B 15/06 66/110
2,374,857 A * 5/1945 Fregeolle ..... D04B 9/46 66/108 A
(Continued)

FOREIGN PATENT DOCUMENTS

DE 1084420 B 6/1960
DE 102013104189 A1 11/2013
(Continued)

OTHER PUBLICATIONS

International Search Report and Written Opinion dated Apr. 11, 2019, in corresponding International Application No. PCT/EP2019/077320 (9 pages).
(Continued)

*Primary Examiner* — Danny Worrell
*Assistant Examiner* — Aiying Zhao
(74) *Attorney, Agent, or Firm* — Fitch, Even, Tabin & Flannery LLP

(57) ABSTRACT

A device (1), a sinker arrangement (5) and a method for loop-forming are described. The device (1) may include a cylinder (2) with first grooves (3) for needles (4) accommodated in a first groove (3), whereby the needles (4) include a loop forming section, and a sinker ring (27) with second grooves (15) for the sinker arrangement (5). The sinker arrangement (5) may include an actuating section (12) and a loop forming section (7). The loop forming section (7) includes an opening (11), and the sinker arrangements (5) are accommodated in one single second groove (15). The
(Continued)

opening (11) may be delimited in the width direction (x) by two side faces (23) and the loop forming section of the needle (4) is movably disposed between the two side faces (23) of the opening (11).

17 Claims, 8 Drawing Sheets

(58) Field of Classification Search
USPC ..... 66/104, 217
See application file for complete search history.

(56) References Cited

U.S. PATENT DOCUMENTS

| | | | | | |
|---|---|---|---|---|---|
| 2,662,383 | A * | 12/1953 | Lombardi | D04B 15/06 | 66/215 |
| 3,540,237 | A * | 11/1970 | Agulnek | D04B 15/14 | 66/107 |
| 3,668,902 | A * | 6/1972 | Sanders | D04B 15/06 | 66/54 |
| 4,689,971 | A * | 9/1987 | Conti | D04B 15/34 | 66/25 |
| 7,757,516 | B1 * | 7/2010 | Starbuck | D04B 15/06 | 66/104 |
| 9,732,451 | B2 | 8/2017 | Lee et al. | | |
| 10,011,927 | B2 | 7/2018 | Fukui | | |

FOREIGN PATENT DOCUMENTS

| | | | | |
|---|---|---|---|---|
| EP | 2038460 | A1 | 3/2009 | |
| FR | 1468592 | A * | 2/1967 | D04B 15/06 |
| KR | 10-2013-0094256 | A | 8/2013 | |
| KR | 10-1346940 | B1 | 1/2014 | |
| WO | WO-9504176 | A1 * | 2/1995 | D04B 15/10 |
| WO | 2008003463 | A1 | 1/2008 | |
| WO | 2012055591 | A1 | 5/2012 | |

OTHER PUBLICATIONS

Korean Notice of Preliminary Rejection, dated Aug. 13, 2021, in corresponding Korean Application No. 10-2021-7014623, with English translation (16 pages).

* cited by examiner

DEVICE FOR LOOP-FORMING, SINKER MEANS AND METHOD FOR LOOP FORMING

CROSS REFERENCE TO RELATED APPLICATIONS

This patent application is the national phase of PCT/EP2019/077320, filed Oct. 9, 2019, which claims the benefit of European Patent Application No. 18202046.1, filed Oct. 23, 2018.

TECHNICAL FIELD

The present invention relates to a device for loop forming, to a sinker means that can be used in a device for loop forming and to a method for loop forming.

BACKGROUND

WO2012055591A1 discloses a device for loop forming with a high gauge that can be manufactured with competitive costs and on the other hand provides high strength and reliability. Another object is to reduce energy consumption. To achieve these objects, the cylinder has a number of channels (or grooves) for sliding of the needles which is smaller than the number of channels (or grooves) for the front parts of the needles which form knitted fabric. Additionally, WO2012055591A1 discloses, for a circular knitting machine without sinkers, a knitting retention element that is placed outside the cylinder. The knitting retention element comprises a heel and a portion that defines a stop shoulder for the knitting, so as to contrast the traction of the knitting along the needles during the extraction motion thereof.

DE102013104189A1 discloses a pair of sinkers that is intended to be inserted in one single groove of a sinker ring. The first sinker 1 comprises means for loop forming (holding down and knocking over) in its front section 14, whereas the second sinker 2 is intended for reducing loads on the butt of the first sinker and for decreasing the energy consumption of the knitting machine. The sinkers comprise apertures and thickened sections where the sinkers penetrate but do not contact each other. In these sections and between the sinkers there are recesses which can accumulate lint. Any two adjacent needles of the loop forming device presented in the aforementioned publication DE102013104189A1 fence in the loop forming sections of the above described pair of sinkers.

Knitting machines provided with the above mentioned devices for loop forming have proven to work with a high reliability as long as the mechanical components are not covered by lint that is generated during loop forming when for example natural filament yarn is knitted. The lint accumulates in the grooves of the device for loop forming so that an accurate movement of the needles and sinkers is no longer possible with a high reliability.

SUMMARY

It is the object of the present invention to provide a device for loop-forming, whereby the device is easier to manufacture and which is also less prone to become clogged by lint. A respective sinker means and a method for loop forming are also claimed.

The inventive device for loop-forming comprises a cylinder comprising at least one first groove for at least partially accommodating at least one needle and a sinker ring with at least one second groove for at least partially accommodating at least one sinker means. In this context "at least partially" means that there are parts of the respective knitting tool which are at least temporarily (dependent on the movement of the knitting tool in the grooves) accommodated in the respective grooves whereas other parts of the knitting tools protrude out of the grooves in their length direction or in their height direction. In most cases, at least the actuating section of the at least one sinker means will at least partially be accommodated in a second groove. Advantageously one first groove accommodates only one single needle.

As already mentioned above, the device for loop-forming comprises at least one sinker means and at least one needle. The at least one sinker means comprises an actuation section for its actuation. In a preferred embodiment the actuating section comprises a butt that can be actuated by a cam track. Some preferable embodiments have actuating sections with butts that can be actuated by a single cam track. Some of these embodiments comprise a so-called single-element sinker means which consists only of one single piece. Other sinker means consist of two distinct sinkers. However, even these two distinct sinkers can be provided by an actuation section which is actuated by one single cam track.

The at least one sinker means, preferably the actuation section of the at least one sinker means is partly arranged in one single second groove of the sinker ring. A loop forming section of the at least one sinker means is intended for knocking over and holding down loops. Preferably, the sinker means comprises a knocking over edge that is involved in forming a loop when the needle is retracted into the cylinder and an edge for holding down the fabric or at least a stitch when the needle is rising out of the cylinder to catch a yarn. Sinkers providing these two functions are state of the art since decades and they are used in various different devices. Usually, sinkers are stamped parts of thin metal stripes and most of them comprise a butt. Therefore, the man skilled in the art understands that the width direction (x) of the sinker points in the direction of the thickness of the sheet metal the sinker is stamped of. The length direction of the sinker (y) is often rectangular to the faces of the butt interacting with the cam track. The height direction (z) is rectangular to both of the before mentioned directions. The loop forming section of the at least one sinker means comprises an opening for accommodating the loop-forming section of the at least one needle, whereby the opening is delimited in the width direction (x) of the sinker means by two side faces. This statement also applies for embodiments which include so called single element sinker means which consist only of one single piece and embodiments with sinker means which consist of two distinct sinkers. In most embodiments of the second aforementioned kind (two distinct sinkers), the two different side faces of the opening belong to the two different sinkers which form the sinker means. In case of sinker means which consists of two distinct sinkers a slot divides the two distinct sinkers. The opening forms then a part of the longitudinal extension of the sinker means where the slot is wide enough to encompass the loop forming section of a needle. The distance between two side faces of the at least one sinker means is in most cases bigger than nil.

The at least one needle comprises a loop forming section which is a part of its longitudinal extension. During the loop forming process the needle has to interact with yarn. In this section of the longitudinal extension of the needle, which is in most cases near the front end portion of the needle, the needle often comprises a hook and a latch. The loop forming section is at least in part movably disposed between the two side faces of the opening of the loop forming section of the at least one sinker means. The part of the loop forming section of the needle can be movably housed and/or laterally interposed and/or encompassed by the side faces of the opening. The side faces of the opening can fence in a part of the loop forming section of the needle. The loop forming section of the needle and the side faces of the at least one sinker means are usually not in contact with each other. A sinker means which is arranged in one single second groove and which comprises an opening with two side faces for movably disposing the loop forming section of a needle has various advantageous effects. The second grooves in the sinker ring can be manufactured wider (broader). As a consequence, the second grooves have a lower height to width ratio. Therefore, manufacturing of the grooves becomes easier, faster and cheaper. When the sinker means are removed from the sinker ring the grooves which have a lower height to width ratio are easier to clean. Surprisingly, the device for loop forming according to the invention is less prone to become clogged by lint. Hence, the reliability of device is increased. All aforementioned features of the inventive device solve the problem of the invention in a very surprising manner when they are provided with at least one needle which is at least in the height direction of the sinker means movable in relation to the sinker means. Preferably, the at least one needle is movable to the sinker means in an angle of 90° to the length direction (y) of the sinker means (most advantageously). The at least one needle can be movable in relation to length direction of the sinker means in an angle of 80°, 100° or in an angle of 60 to 120° or in any other angle. The at least one needle, or at least its actuating section which comprises a part of its longitudinal extension, is arranged and movably held in a first groove in the cylinder. This measure provides for a lot of beneficial opportunities.

A complete cleanup operation of the knitting machine is not necessary since the device for loop forming is self-cleaning, or is accelerated and becomes less burdensome. Moreover, obligatory cleanup operations become due less frequently or not due. The periods of time between obligatory maintenance or service stops of the device for loop forming are prolonged. It is supposed that conventional lint reducing systems as ventilators can more easily remove the fibre or filament pieces (main component of lint) out of the grooves when the grooves have a lower height to depth ratio. Surprisingly, this statement explicitly also applies when the dimensions of the play between the actuating sections of the sinker means and the side walls of the grooves are unchanged with regard to common state-of-the-art devices. It is beneficial when the number of second grooves in the sinker ring is smaller than the number of first grooves in the cylinder. The number of third grooves can be smaller than the number of first grooves. Advantageously, the number of second and/or third grooves is e.g. half the number of first grooves.

It is beneficial to provide an inventive device with at least one second groove (for partly accommodating the actuating section of the sinker means) which is at most 3.5 times deeper than wide. This additional feature can easily be provided in devices with the aforementioned combination of features. The respective grooves can easily be cleaned or do not need to be cleaned. The height of the grooves of the sinker ring can be as stated in other words directly above—at most 3.5 times the width of said grooves. It can also be advantageous when the height of the grooves of the sinker ring is at most 2.5 times the width of said grooves. As already mentioned above the at least one sinker means can either comprise two distinct sinkers or a single-element sinker means which consists only of one single piece. In the case of a single-element sinker means which consists only of one single piece the above mentioned ratio of the depth of the at least one second groove of the device for loop forming divided by its width is advantageously at most 2.5. An advantageous depth of the at least one second groove is about 1.6 mm. The depth of the at least one second groove can advantageously be between 1.2 mm and 2 mm and even more advantageously between 1.4 mm and 1.8 mm. The width of the at least one second groove can advantageously be between 70% and 110% and even more advantageously be around 90% of the pitch of the device for loop forming in case the sinker means comprises two distinct sinkers, especially when at least one single sinker of the two distinct sinkers has a varying width over its length. When every single sinker has a constant width even a width of the at least one second groove can advantageously be between 35% and 55% and even more advantageously be around 45% of the pitch of the device for loop forming. The width of the at least one second groove can advantageously be between 100% and 140% and even more advantageously be around 120% of the pitch of the device for loop forming when the sinker means comprises a single-element sinker means which consists only of one single piece. It is also beneficial to apply a width of the at least one second groove of about 120% of the pitch when a sinker means which consists of two distinct sinkers with varying width is used in the device for loop forming. The person skilled in the art knows that the pitch of a device for loop forming is e.g. 1.15 mm for a device designated 22*gg*, 0.91 mm for a device designated 28*gg* and 0.64 mm for a device designated 40*gg*.

When two distinct sinkers are used as a sinker means it is beneficial to provide at least one of the two sinkers with at least one curved or bending section. This is one possibility to provide for the opening: the curved or bending section of the at least one sinker which could be provided with the curved or bending section provides for a distance between the two sinkers in width direction of the sinker means which makes them form the opening in the respective loop forming section. A comparable result can be achieved by providing both distinct sinkers with at least one curved or bending section. Another advantageous embodiment can be a sinker means consisting of two distinct sinkers where at least one first sinker comprises a section of its longitudinal extension which has a reduced width in order to form the opening between the two distinct sinkers. Then, the section with the reduction of the width is curved in the sense of this application. A reduction of the width of an inventive distinct sinker in the loop forming section for providing the opening can be in the range of 25% to 70%, or in the range of 30% to 60%, or at least 25%, or at least 30%, or at least 40% of the width or the greatest width of the actuating section. In any embodiment the curvature can be in the plane of the width and the length direction of the sinker means, regardless the curvature is because of a bending or a reduction of the width. The curved section or curved sections for providing the opening can be in any section of the longitudinal extension of the sinker means as the actuating section, the loop forming section, a middle section or every other section. The sinker means comprising two distinct sinkers arranged in one single groove of the sinker ring can comprise at least a first of the both opposing surfaces of any of the two loop forming sections of the distinct sinkers directing in width direction of the sinkers being at least partially parallel displaced in the same direction to at least a first of the both opposing surfaces of at least a part of an actuating section of the distinct sinkers directing in said direction. An embodiment of an sinker means with two distinct sinkers comprising at least one bending section can comprise both opposing surfaces of the loop forming sections of the sinkers directing in width direction of the distinct sinkers being at least partially parallel displaced in the same direction to both opposing surfaces of at least a part of an actuating section of the distinct sinkers directing in said direction. The actuating section of the at least one sinker means advantageously fits with generally known tolerances into the at least one second groove.

It is beneficial to provide a single-element sinker means with an actuating section which includes at least a part of its extension in the length direction (y) of the sinker means and which is at most 3.5 times, or at most 3 times, or at most 2.5 times higher (extension in the height direction z) than wide (extension in the width direction x). The actuating section of the at least one sinker means advantageously fits with commonly known tolerances into the at least one second groove. A single-element sinker means consisting of one piece can comprise single piece machined from one flat stamped metal part. A single piece joined from different parts and even different materials can also be advantageous.

A sinker means for an inventive loop forming device has an actuating section with an actuating means which is at most 2.5 times higher (extension in the height direction z) than wide (extension in the width direction x) for smaller pitches (e.g. 50*gg*). In case of greater pitches (e.g. 22*gg*) at least a section of the extension in the length direction (y) of the sinker means is nearly as wide as high. Such ratios provide for a width of the actuating section of the sinker means which is the pitch of the device for loop forming multiplied by a factor of about 1,3.

It is also advantageous to provide at least one third groove which partly accommodates the front section and/or the loop forming section of the at least one sinker means. Further advantages arise if this at least one third groove is at most 3,5 times, or at most 3 times, or at most 2 times deeper than wide. Advantageously, the depth of the at least one third groove can be between 0.9 mm and 1.3 mm and even more advantageously around 1.1 mm. The width of the at least one third groove can be between 0.6 mm and 1.5 mm dependent on the pitch of the device for loop forming. Most beneficially, the width of the at least one third groove is about 1.3 times the pitch of the device of loop forming when a single-element sinker means is provided. The same applies for some embodiments with distinct sinkers. It is also beneficial for second and third grooves to meet the following conditions: the bottom of the at least one second groove is in the direction of the central axis of the cylinder higher or at the same height as the bottom of the at least one third groove. The addition of this measure to inventive devices reduces lint in a surprising manner, especially in the second groove. The at least one third groove will have to be incorporated or contained in a member, which is in any way part of the machine. In general, there will be a higher number of third grooves which are in any way included in the ring (circular knitting) or a longitudinal member of a flat knitting machine. In most circular knitting machines this member is a ring, which is part or which is at least connected with the cylinder which incorporates the at least one first groove for the needle.

It is beneficial to additionally provide the respective member with at least one inward edge, whereby the at least one inward edge forms an acute angle in the plane of the length (y) and height direction (z) of the sinker means with the bottom of the at least one third groove, and whereby the at least one inward edge points towards the central axis of the cylinder. This measure further reduces lint. The acute angle on the inward edge forms a sharp edge that can scrap lint from the sinker mean's underside when being retracted into the third groove. No lint enters the third grooves.

Other beneficial embodiments are not provided with third grooves or not provided with third grooves for any sinker means. In this case, the whole member, which incorporates the third grooves or at least part of it is superfluous and can be left out. In these cases, the front section and maybe the loop forming section of the respective sinker means do not contact any member, which is part of the machine. The yarn is in this context not understood as being a "part of the machine".

An inventive sinker means for knocking over and holding down loops comprises:

- an actuating section for its actuation whereby the actuating section of the at least one sinker means is suitable for being at least partially accommodated in one single second groove of a sinker ring and
- a loop forming section for knocking over and holding down loops.

Moreover, an inventive sinker means comprises an opening in its loop forming section.

The opening is at least delimited in the width direction (x) of the sinker means by two side faces for movably disposing at least a part of the longitudinal extension of the loop-forming section of a needle between the two side faces of the opening of the loop-forming section of the at least one sinker means.

Preferably, an inventive sinker means comprises an actuating section which is provided on one section of the extension of the sinker means in its length direction and is suitable for being driven by one single cam track of a knitting machine.

Preferably, the actuating section is suitable for driving both side faces of the opening of the sinker means.

As already expressed before the at least one actuating section has a limited extension in the length direction of the sinker means so that it can be preferably driven by a single cam track. In some cases, one single butt will provide for the actuation by the cam track. If the sinker means consists of two distinct sinkers, each sinker is provided with a butt. The respective actuation section of the sinker means will be understood preferably as a single actuation section as long as the butts have the same position in the length direction of the sinker means. The result of this measure is that there is only a very small relative velocity of the sinkers in the sinker means length direction (y)—if any at all—between the two distinct sinkers during the knitting process. Preferably, the two distinct butts of the two distinct sinkers are actuated almost at the same time. This feature is important for the provision of the opening for fencing in the needle. In other words: the two side faces of the sinker means are preferably driven by the same actuation section.

A sinker means according to the invention consisting of two distinct sinkers can comprise a first sinker having a front section which is wider than the loop forming section. A loop forming section can be wider than a middle section which is between the loop forming section and the actuating section. An actuating section can be wider than the middle section and preferably also wider than the loop forming section. The wide front section and actuating section can provide for grooves in a device for loop forming with a big width to depth ratio. A thinner middle section can provide for sufficient space for the tongue of a needle to pivot adjacent the sinker means without getting in contact to the side faces of the sinker means. The width of the loop forming section can advantageously be smaller than the width of the front section and wider than the width of a middle section to provide a optimum edge for the yarn to be knitted to an uniform mesh.

The at least one sinker means can also be a single-element sinker means which consists only of a single piece. The opening of the single-element sinker means can be delimited in its length direction towards the front section. The opening reaches through the loop forming section. It is beneficial if the front section and the loop forming section of the at least one sinker means does not contact any member which is part of the machine which comprises the inventive device for loop forming. The actuating section of the at least one sinker means can at least partly be slidably accommodated in one single second groove. The loop forming section and the front section can be cantilevered on the cylinder which means among other things that the loop forming section and the front section of the sinker means are not accommodated in third grooves of the cylinder.

An inventive method for loop forming comprises the following actions:

Actuating at least one sinker means in at least one second groove of a sinker ring by means of an actuating section of the sinker means, whereby the at least one sinker means is at least partially accommodated in one single second groove during the knitting process, whereby the sinker means is provided with a loop forming section, which holds down and knocks over loops, whereby the loop forming section of the at least one sinker means comprises an opening.

Actuating at least one needle, which also participates in the loop forming process with its loop forming section, which comprises a part of the longitudinal extension of the needle. The inventive method is characterized in that the opening is delimited in the width direction of the sinker means by two side faces and the at least one needle is moved at least in the height direction of the sinker means between the two side faces of the opening of the loop forming section of the at least one sinker means. Preferably, one single cam track actuates the actuating section of the at least one sinker means which is accommodated in one single second groove.

DETAILED DESCRIPTION

Figure 1:
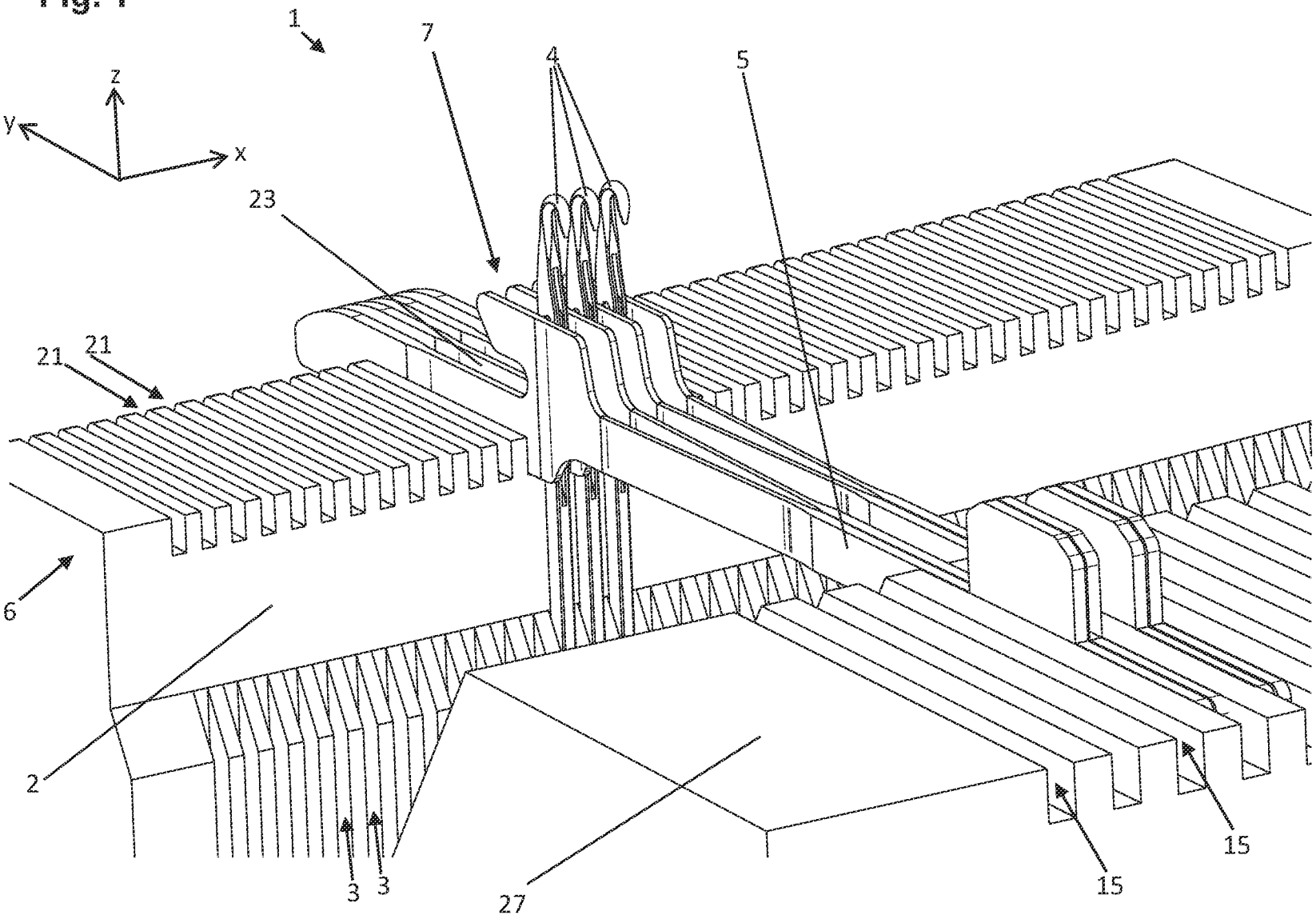
FIG. 1 shows a first embodiment of an inventive device for loop forming.

FIG. 1 shows a first embodiment of an inventive loop forming device 1 which is provided with a cylinder 2. The cylinder comprises first grooves 3 for accommodating needles 4. The loop forming device 1 also comprises a sinker ring 27 which includes second grooves 15 for accommodating sinker means 5. The embodiment shown in FIG. 1 also includes a member 6, which includes third grooves 21 for accommodating the loop forming section 7 of the sinker means 5. The member 6 is connected with, or integral with, the cylinder 2 with the first grooves 3.

Figure 2:
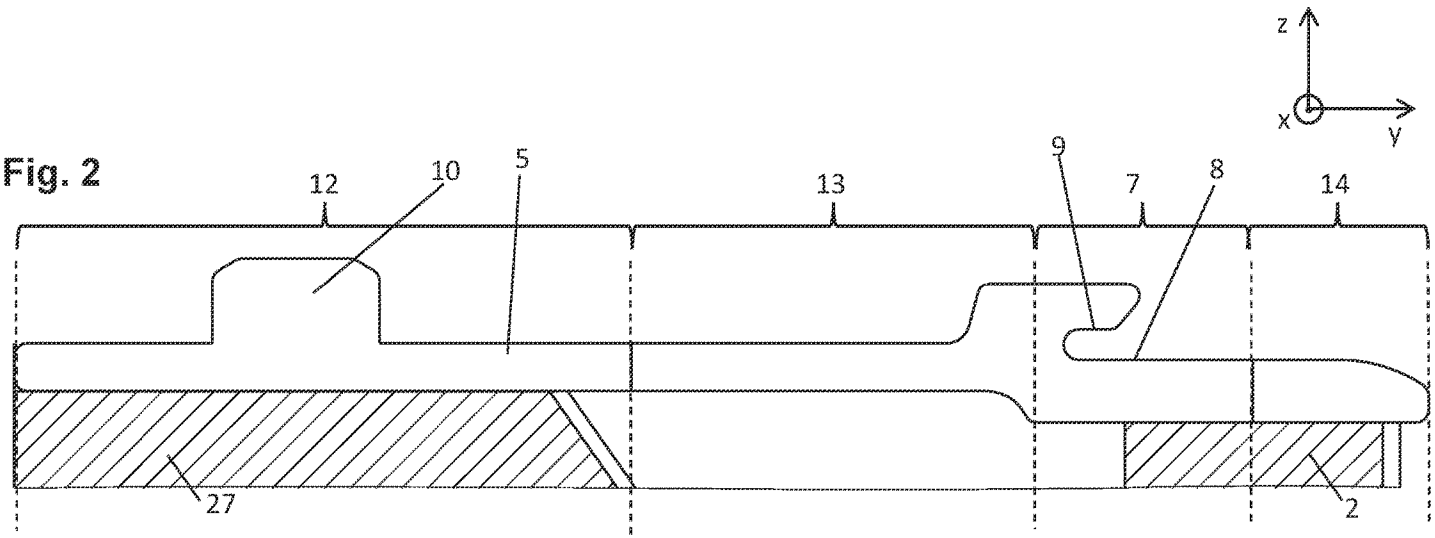
FIG. 2 shows a cut out of a cross-section of the device of FIG. 1 and therefore also a side view of the sinker in a second groove.

FIG. 2 shows a cutout of a cross-section of the loop forming device of FIG. 1. Therefore, FIG. 2 also shows a side view of the sinker means 5 in its working position in a second groove. The sinker means 5 consists of two distinct sinkers 16 (better shown in FIG. 3). These sinkers 16 can be used in the first embodiment of a loop forming device 1.

Figure 3:
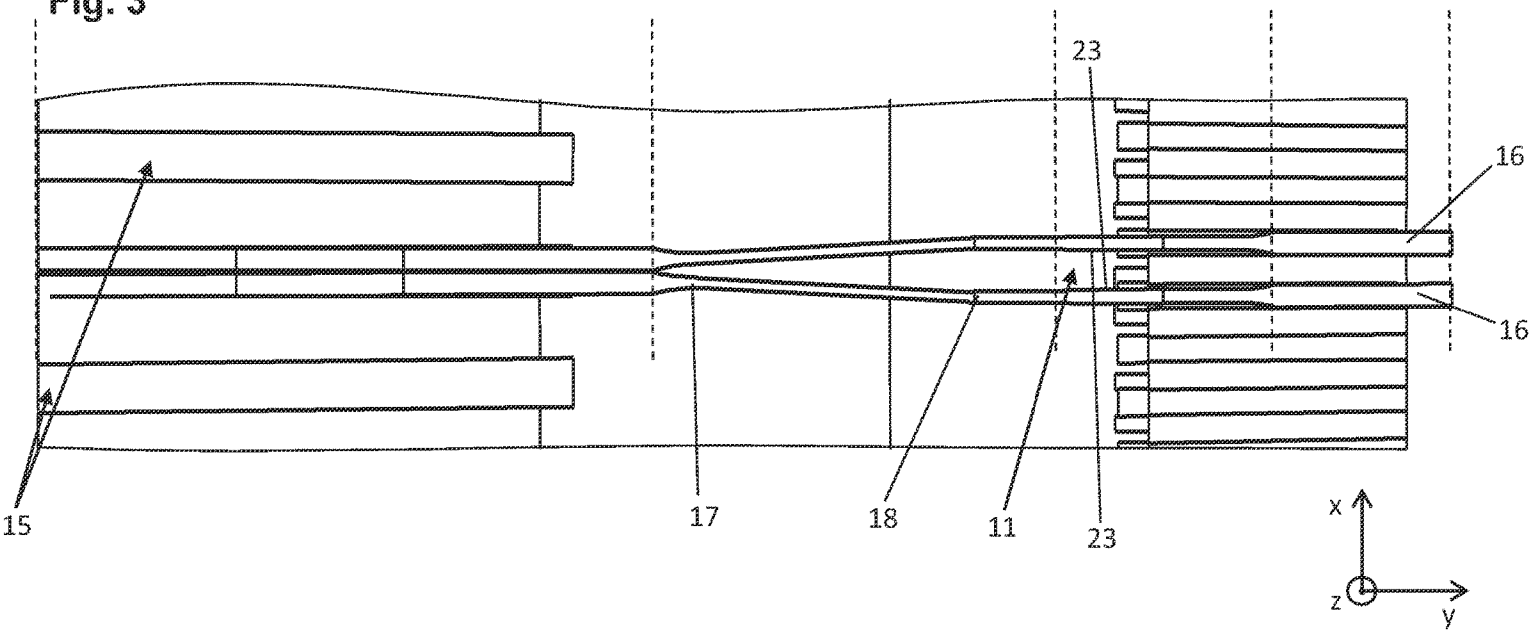
FIG. 3 shows a top view of the sinker and device of FIGS. 1 and 2.

The sinker means 5 is provided with an actuation section 12 which has a butt 10. It also has a loop forming section 7 which is provided with the holding down edge 9 and the knocking over edge 8. The connection between the loop forming section 7 and the actuation section 12 is provided by the middle section 13. The sinker means 5 of FIG. 3 is the same sinker means as in FIG. 2. The sinker means 5 is however shown in a top view of a section of the loop forming device 1. The top view shows the two distinct sinkers 16 in a second groove 15. The adjacent second grooves 15 are empty. The opening 11 for encompassing or housing a part of the longitudinal extension of a needle 4 is also shown in FIG. 3. The needles 4 are not shown. FIG. 3 also shows that the width of the distinct sinkers 16 varies over their extension in their length direction y:

The front section 14 is preferably wider than the loop forming section 7. The loop forming section 7 is preferably wider than the middle section 13. The actuating section 12 is preferably very wide and at least wider than the middle section 13.

Figure 4:
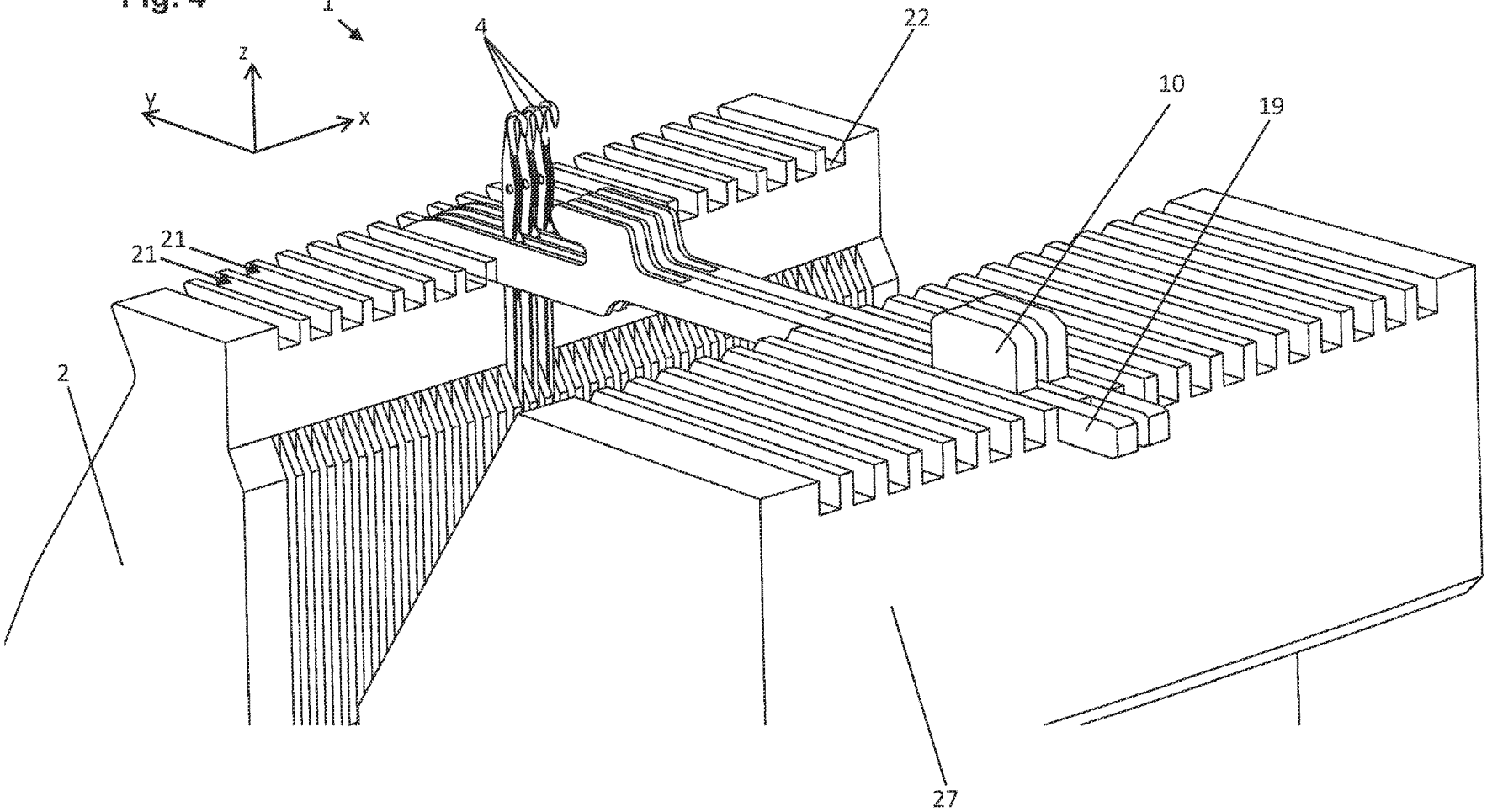
FIG. 4 shows a second embodiment of the inventive device for loop forming.
Figure 5:
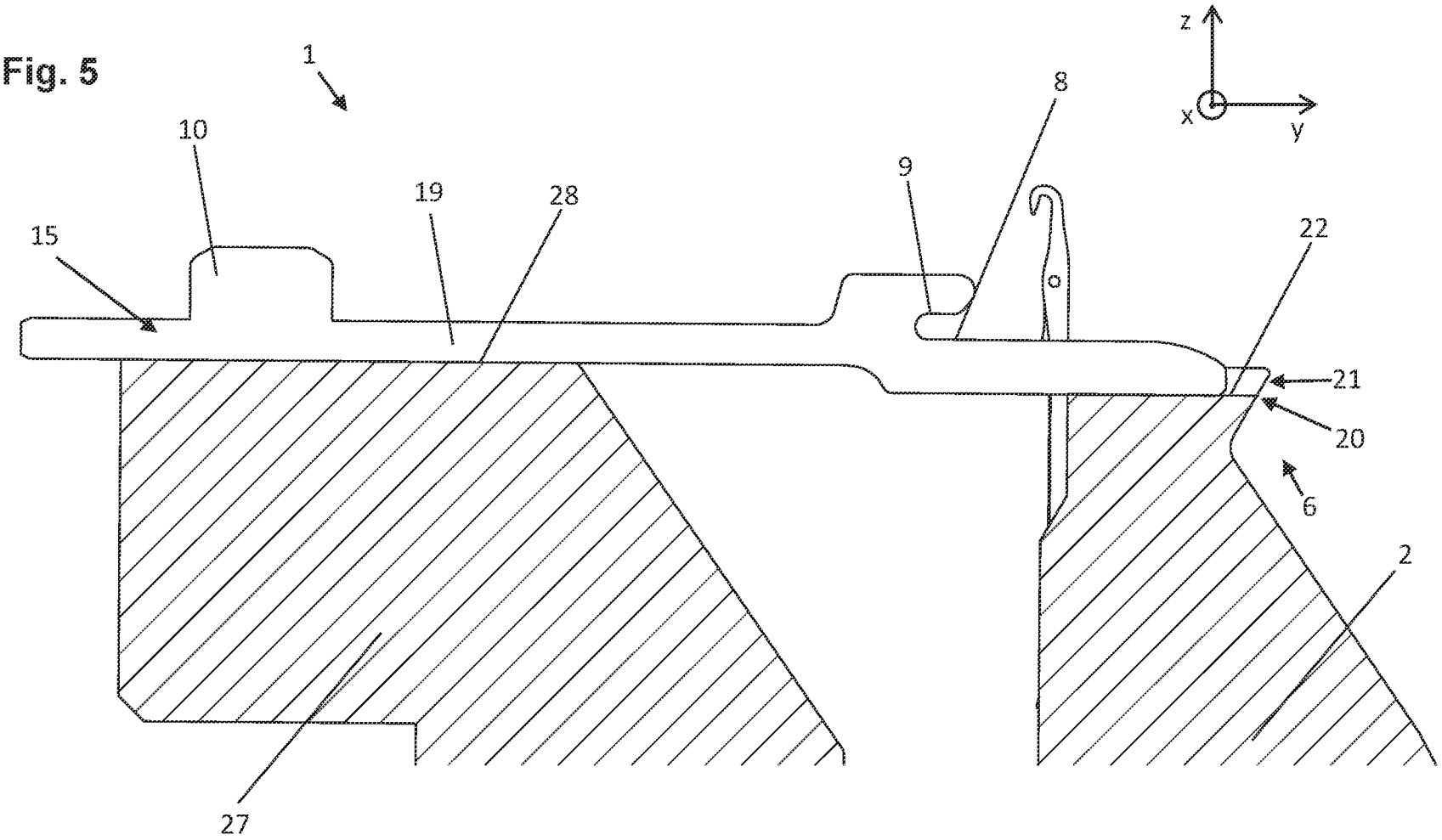
FIG. 5 shows a side view of the embodiment of FIG. 4.
Figure 6:
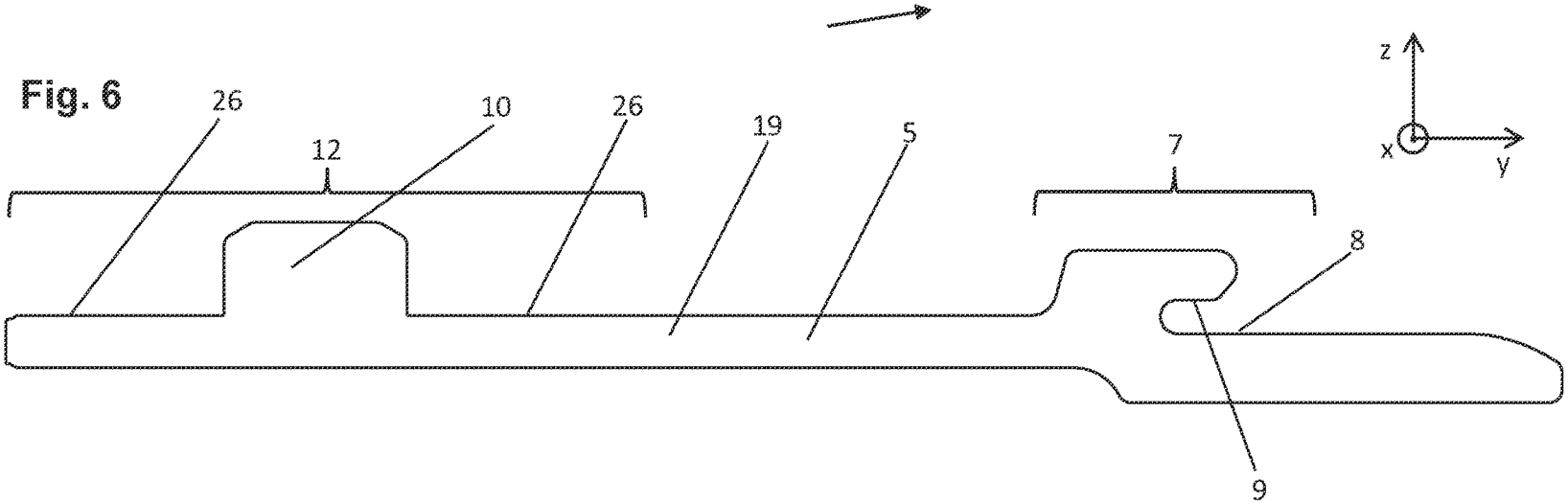
FIG. 6 shows a side view of a single-element sinker means.
Figure 7:
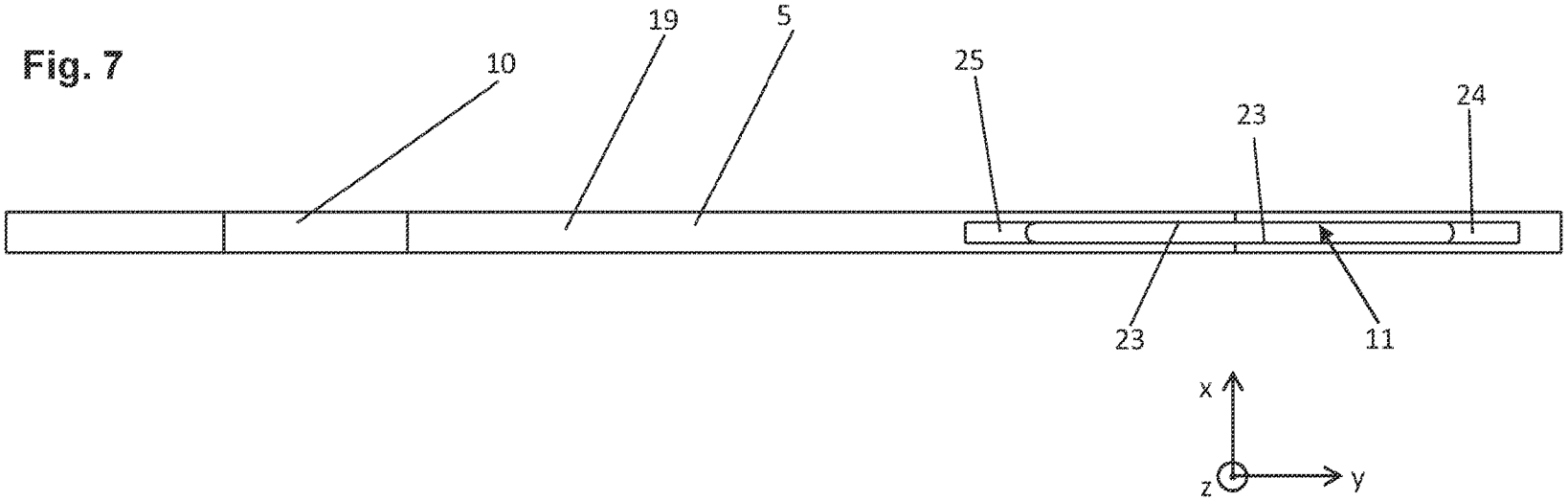
FIG. 7 shows the same single-element sinker means as FIG. 6 in a top view.

FIG. 4 shows a different view on a second embodiment of an inventive loop forming device which is provided with a single-element sinker means 19 which is also shown in FIGS. 5, 6 and 7. The second embodiment is similar to the first one. The most striking difference is the aforementioned choice of a single-element sinker means 19 (second embodiment) instead of two distinct sinkers 16 (first embodiment). FIG. 5 shows a cross section of the second embodiment of the loop forming device 1. FIG. 5 shows the inward edge 20, which is in the embodiment shown a part of the member 6, which incorporates the third grooves 21. The inward edge 20 forms an acute angle with the bottom 22 of the third grooves 21. FIG. 5 also shows that the bottom 28 of the second groove 15 is in the direction of the central axis of the cylinder 2 which is—preferably—the same as the height direction z of the sinker means 19 higher than the bottom 22 of the third groove 21.

FIG. 6 shows that the single-element sinker means 19 comprises roughly the same technical features as the sinker means 5 shown in FIGS. 2 and 3: The butt 10, the holding down edge 9 and the knocking over edge 8 are among the more important functional features shown in FIG. 6. FIG. 7 which is a top view of the same single-element sinker means 19 also shows the opening 11 with the two side faces 23 which fence in the needle 4 in the width direction x of the sinker means 5 (see FIG. 4). The opening 11 can also have a front face 24 in the direction of the tip of the sinker means and a back face 25 in the direction of the actuation section 12. Therefore, it is important to mention that the single-element sinker means 19 which is shown in FIG. 6 is provided with an opening 11 which is completely closed in two dimensions (x and y). In other embodiments, the sinker means 5 will at least not be provided with a front face 24. As exemplarily shown in FIG. 6, the upper edges of the shaft sections 26 can be—in the height direction z of the sinker means—higher than the knocking over edge 8 of the loop forming section 7 of the sinker means 5. This feature has considerable benefits for the avoidance of lint.

Figure 8:
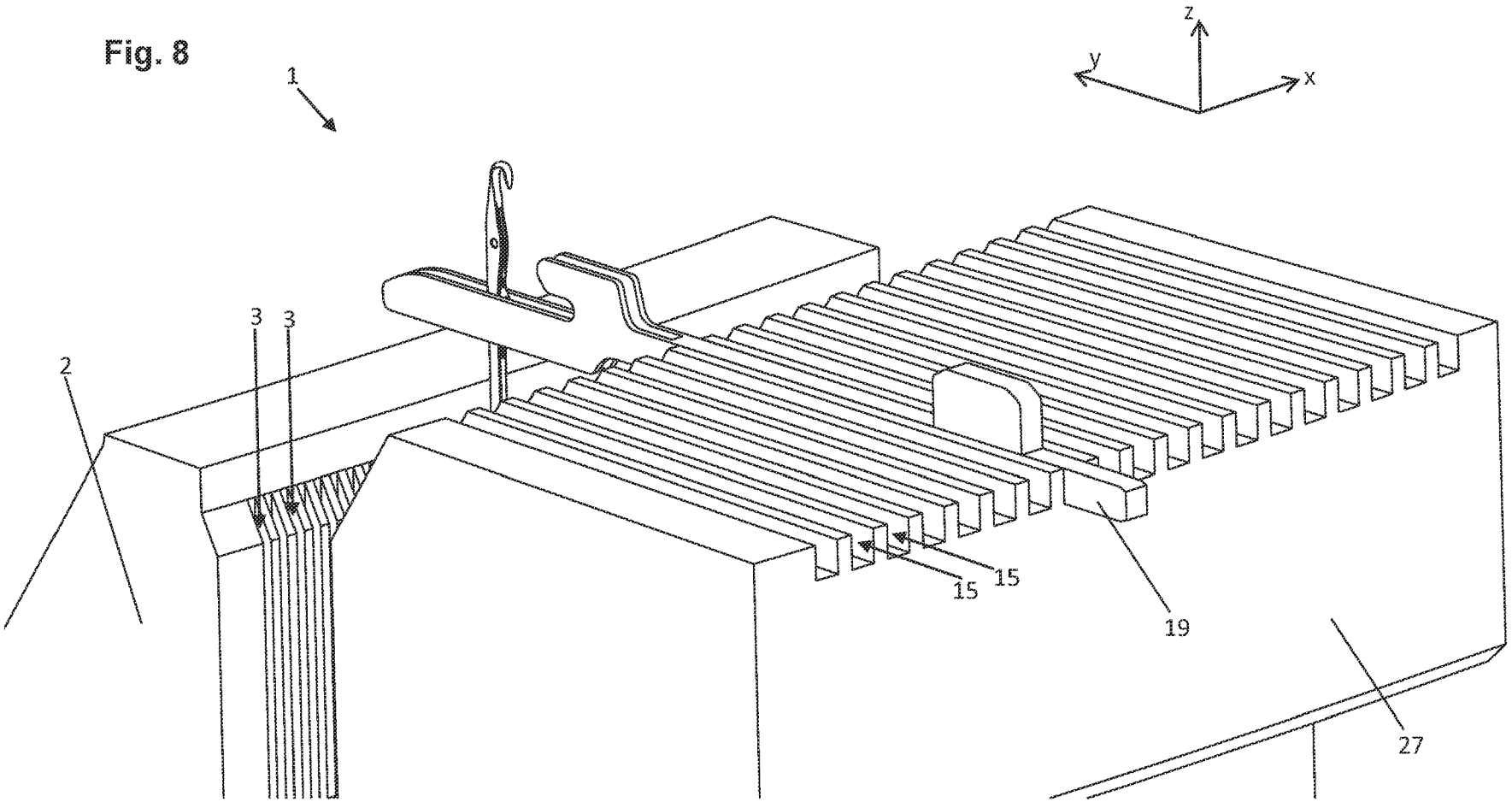
FIG. 8 shows a further (third) embodiment of the loop forming device which is not provided with third grooves.
Figure 9:
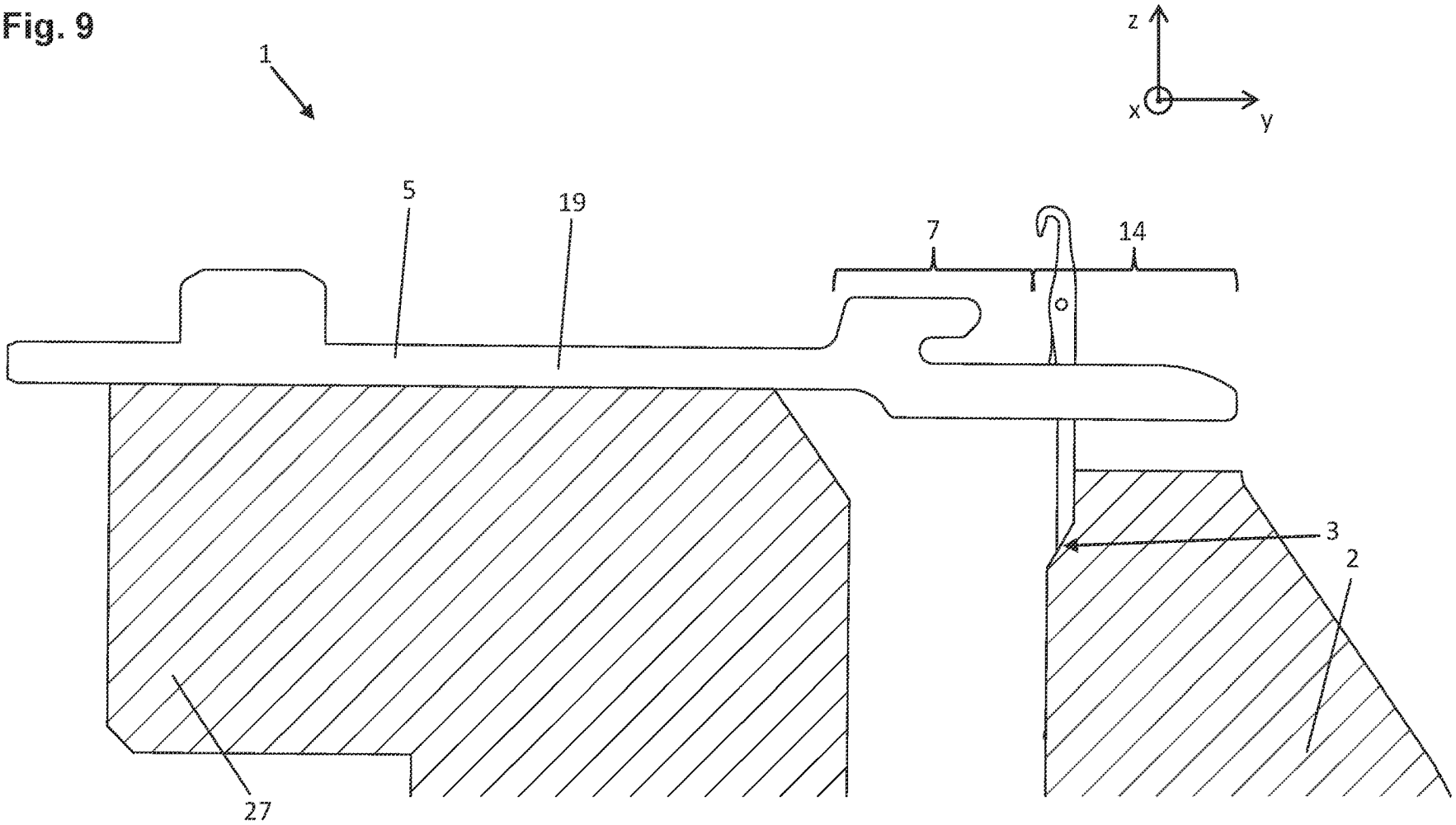
FIG. 9 shows the embodiment of FIG. 8 in a side view.

FIGS. 8 and 9 show a third embodiment of an inventive loop forming device. This third embodiment is similar to the second one: both embodiments use a single-element sinker means 19. However, the third embodiment is not provided with a member 6, which incorporates third grooves 21. Therefore, the third embodiment is not provided with any third grooves 21. The consequence of this fact is that the loop forming section 7 and the front section 14 of the at least one sinker means 5 protrude in the length direction y of the sinker means 5 out of the second grooves 15. These two sections are in the present embodiment not in any contact with a further part of the loop forming device 1. The sinker ring 27 with its second grooves 15 is however in contact with the rear part of the sinker means 5.

Figure 10:
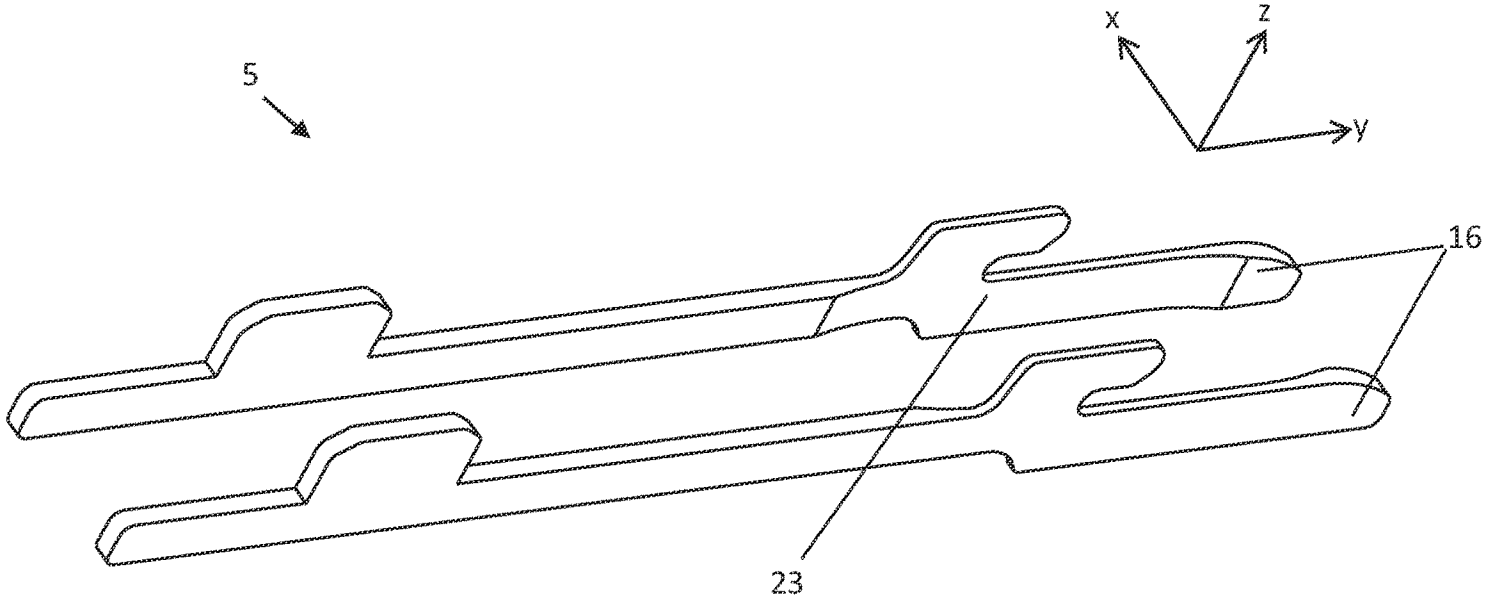
FIG. 10 shows a sinker means which consist of two distinct sinkers with reduced width which are displaced from each other.
Figure 11:
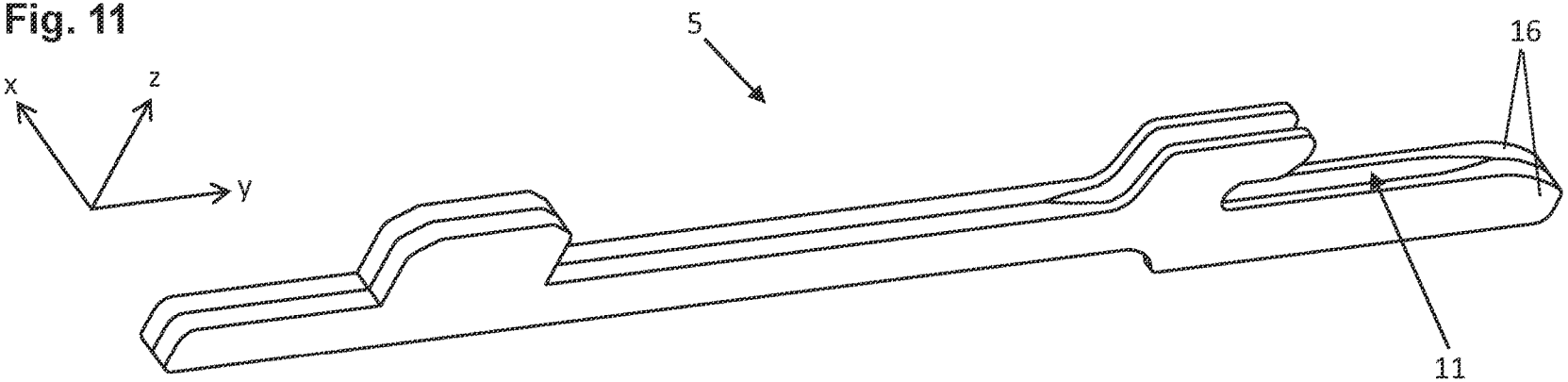
FIG. 11 shows the sinker means already shown in FIG. 10 with the two distinct sinkers in their working position with regard to each other.

FIGS. 10 and 11 once again show a sinker means 5 which consists of two distinct sinkers 16. In FIG. 10 the two distinct sinkers 16 have a distance from each other. In FIG. 11 their side faces have contact with each other like in their working position when the two distinct sinkers 16 are encompassed by a second groove 15. FIGS. 10 and 11 also show that these two distinct sinkers 16 form an opening 11, when their side faces meet like in FIG. 11.

List of numerals

| | |
|---|---|
| 1 | Loop forming device |
| 2 | Cylinder with first grooves |
| 3 | First grooves |
| 4 | Needles |
| 5 | Sinker means |
| 6 | Member |
| 7 | Loop forming section of the sinker means 5 |
| 8 | Knocking over edge |
| 9 | Holding down edge |
| 10 | Butt |
| 11 | Opening for encompassing a part of the longitudinal extension of needles 4 |
| 12 | Actuation section |
| 13 | Middle section |
| 14 | Front section |
| 15 | Second grooves |
| 16 | Distinct sinker |
| 17 | First bending section |
| 18 | Second bending section |
| 19 | Single-element sinker means |
| 20 | Inward edge |
| 21 | Third grooves |
| 22 | Bottom of a third groove 21 |
| 23 | Side faces of the opening 11 |
| 24 | Front face (in the direction of the tip of the sinker means 5) |
| 25 | Back Face (in the direction of the actuating section 12) |
| 26 | Upper edge of shaft section |
| 27 | Sinker ring |
| 28 | Bottom of a second groove 15 |
| x | Width direction of the sinker means 5 |
| y | Length direction of the sinker means 5 |
| z | Height direction of the sinker means 5 |

The invention claimed is:

1. A device (1) for loop-forming, comprising:

a cylinder (2) comprising at least one first groove (3) for accommodating at least one needle (4);

a sinker ring (27) with at least one second groove (15) for accommodating at least one moveable sinker means (5);

at least one moveable sinker means (5), which comprises an actuating section (12) for actuation of an entirety of the at least one sinker means in a reciprocating manner and a loop forming section (7) for knocking over and holding down loops of yarn formed by knitting;

wherein the loop forming section (7) of the at least one moveable sinker means (5) comprises an opening (11), which moves together with the at least one moveable sinker means (5);

and wherein the at least one moveable sinker means (5) is at least partially accommodated in the at least one second groove (15);

at least one needle (4) which is at least partially accommodated in a first groove (3), wherein the at least one needle (4) comprises a loop forming section that comprises a part of a longitudinal extension of the at least one needle (4);

wherein the opening (11) is delimited in a width direction (x) of the at least one moveable sinker means (5) by two side faces (23) and the loop forming section of the at least one needle (4) is at least in part movably disposed between the two side faces (23) of the opening (11).

2. The device (1) for loop-forming according to claim 1, wherein the at least one second groove (15) is at most 3.5 times deeper than its width.

3. The device (1) for loop-forming according to claim 1, wherein the at least one moveable sinker means (5) comprises two distinct sinkers (16)

and at least a first of the two distinct sinkers (16) comprises at least one curved section.

4. The device (1) for loop-forming according to claim 1, wherein the at least one moveable sinker means (5) is a single-element sinker means (19) which only consists of a single piece.

5. The device (1) for loop-forming according to claim 4, wherein the actuating section (12) of the single-element sinker means (19) includes at least a section of its extension in a length direction (y) of the single-element sinker means (19) which is at most 3.5 times taller than its width.

6. The device (1) for loop-forming according to claim 5, further comprising at least one third groove (21) of the cylinder (2) for at least partly accommodating the loop-forming section (7) of the single-element sinker means (19), wherein the at least one third groove (21) is at most 3.5 times deeper than its width.

7. The device (1) for loop-forming according to claim 6, wherein a bottom (28) of the at least one second groove (15) is-positioned at a same height or higher than a bottom (22) of the at least one third groove (21) in a direction of a central axis of the cylinder.

8. The device (1) for loop-forming according to claim 6, further comprising a member (6) having the at least one third groove (21), wherein the member (6) forms a part of the cylinder (2) and includes at least one inward edge (20), whereby the at least one inward edge (20) forms an acute angle with a bottom (22) of the at least one third groove (21) in a plane defined by a length (y) and a height direction (z) of the at least one moveable sinker means (5), wherein the at least one inward edge (20) points towards a central axis of the cylinder.

9. The device (1) for loop-forming according to claim 4, wherein a front section (14) and the loop forming section (7) of the single-element sinker means (19) do not contact the cylinder (2).

10. A sinker means (5) for knocking over and holding down loops, comprising:

an actuating section (12) for actuation of the sinker means, wherein the actuating section (12) is configured for being at least partially accommodated in one second groove (15) of a sinker ring (27); and a loop forming section (7) integrally connected with the actuating section so as to be moveable therewith for knocking over and holding down loops of yarn formed by knitting, wherein the loop forming section (7) comprises an opening (11);

wherein the opening (11) is delimited in a width direction (x) of the sinker means (5) by two side faces (23) each integrally connected with the actuating section so as to be moveable therewith for movably disposing at least a part of a longitudinal extension of a loop-forming section of a needle (4) between the two side faces (23).

11. The sinker means (5) according to claim 10, wherein the actuating section (12) extends along a length direction of the sinker means (5) and is configured for being driven by one single cam track of a knitting machine, and wherein the actuating section (12) is configured for driving both of the two side faces (23) of the opening (11).

12. The sinker means (5) according to claim 10, further comprising two distinct sinkers (16)

and at least a first of the two distinct sinkers (16) comprises at least one curved section.

13. The sinker means (5) according to claim 12, wherein the first of the two distinct sinkers (16) has a front section (14) which is wider than the loop forming section (7), and wherein the loop forming section (7) is wider than a middle section (13) which is between the loop forming section (7) and the actuating section (12) and the actuating section (12) is wider than the middle section (13) and wider than the loop forming section (7).

14. The sinker means (5) according to claim 10, wherein the sinker means (5) is a single-element sinker means (19) which consists only of a single piece, and wherein the opening (11) is delimited in a length direction (y) towards a front section (14) of the sinker means.

15. The sinker means (5) according claim 10, wherein the loop forming section (7) is provided with a knocking-over edge (8), wherein the actuating section (12) comprises a butt (10) and two shaft sections which surround the butt (10), wherein at least one of the two shaft sections has an upper edge (26), and wherein the upper edge (26) of the at least one shaft section is positioned above the knocking-over edge (8) in a height direction (z) of the sinker means (5).

16. A method for loop forming, comprising:

actuating at least one moveable sinker means (5) in at least one second groove (15) of a sinker ring (27) via an actuating section (12) of the at least one moveable sinker means (5) such that an entirety of the at least one moveable sinker means (5) is moved in a reciprocating manner;

wherein the at least one moveable sinker means (5) is at least partially accommodated in the at least one second groove (15) during a knitting process;

wherein the at least one moveable sinker means (5) is provided with a loop forming section (7), which holds down and knocks over loops of yarn formed by knitting;

wherein the loop forming section (7) of the at least one moveable sinker means (5) comprises an opening (11) that moves together with the at least one moveable sinker means;

actuating at least one needle (4), wherein a loop forming section of a longitudinal extension thereof participates in a loop forming process;

wherein the opening (11) is delimited in a width direction (x) of the at least one moveable sinker means (5) by two side faces (23) and the at least one needle (4) is moved at least in a height direction (z) of the at least one moveable sinker means (5) between the two side faces (23) of the opening (11).

17. The method according to claim 16, further comprising actuating the actuating section of the at least one moveable sinker means (5) with one single cam track, wherein the at least one moveable sinker means (5) is accommodated in the at least one second groove (15).

* * * * *